US009840825B2

(12) United States Patent
Biggs et al.

(10) Patent No.: US 9,840,825 B2
(45) **Date of Patent: *Dec. 12, 2017**

(54) IMPLEMENT END CUTTING-BIT

(71) Applicant: Caterpillar Inc., Peoria, IL (US)

(72) Inventors: Nick W. Biggs, Princeville, IL (US); Thomas Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 425 days.

This patent is subject to a terminal disclaimer.

(21) Appl. No.: 14/012,521

(22) Filed: Aug. 28, 2013

(65) Prior Publication Data

US 2015/0060097 A1 Mar. 5, 2015

(51) Int. Cl.
*E02F 3/815* (2006.01)
*E02F 9/28* (2006.01)

(52) U.S. Cl.
CPC ..... *E02F 3/8152* (2013.01); *E02F 9/2858* (2013.01); *E02F 9/2883* (2013.01)

(58) Field of Classification Search
CPC ..... E02F 3/8152
USPC ..... 172/701.2, 772.5
See application file for complete search history.

(56) References Cited

U.S. PATENT DOCUMENTS 2,732,639 A * 1/1956 Lillengreen ..... E02F 3/8152 172/701.2
2,831,275 A * 4/1958 Kimsey et al. ..... E02F 9/28 172/701.2
2,914,868 A * 12/1959 Launder ..... E02F 3/8152 172/701.2
2,965,989 A * 12/1960 Hibbard ..... E02F 3/8152 172/701.2
3,029,534 A * 4/1962 Rakisits ..... E02F 3/8152 172/701.2
3,289,331 A * 12/1966 Freeman ..... E02F 3/8152 144/34.1
3,456,370 A * 7/1969 Gilbertson ..... E02F 3/8152 172/701.2
3,465,833 A 9/1969 Lutz
(Continued)

FOREIGN PATENT DOCUMENTS

CN 101903602 12/2010
CN 202298714 7/2012
(Continued)

*Primary Examiner* — Thomas B Will
*Assistant Examiner* — Joel F. Mitchell
(74) *Attorney, Agent, or Firm* — Leydig, Voit & Mayer, Ltd.

(57) ABSTRACT

An implement end cutting-bit with a body having front, rear, top, bottom, inner side and outer side portions. The body has a cutting edge along a bottom interface between the front and bottom portions. The body has a flat front surface on the front portion extending between a top edge along a top interface between the front and top portions, an outer side edge along an outer side interface between the front and outer side portions, a ridge on the front portion, and a spearhead edge along the bottom interface between the outer side portion and the cutting edge. The body has a contoured front surface on the front portion of the body adjacent the flat front surface. The contoured front surface can be defined between an inner side edge, which is along an inner side interface between the front and inner side portions, the cutting edge, and the ridge.

14 Claims, 17 Drawing Sheets

(56) References Cited

U.S. PATENT DOCUMENTS

| | | | | |
|---|---|---|---|---|
| 3,638,736 | A * | 2/1972 | Hahn | E02F 3/8152 172/701.2 |
| 3,736,676 | A | 6/1973 | Sturgeon | |
| 3,851,711 | A | 12/1974 | Stepe | |
| 3,961,788 | A | 6/1976 | Helton et al. | |
| 4,037,337 | A | 7/1977 | Hemphill | |
| 4,086,967 | A | 5/1978 | Eftefield et al. | |
| 4,390,071 | A | 6/1983 | Wright | |
| 6,398,899 | B1 | 6/2002 | Umezawa et al. | |
| 6,470,606 | B1 | 10/2002 | Nagahiro et al. | |
| 6,938,701 | B2 * | 9/2005 | Matsumoto | E02F 3/7618 172/811 |
| 7,874,085 | B1 | 1/2011 | Winter et al. | |
| 8,191,287 | B2 | 6/2012 | Winter et al. | |
| 8,689,897 | B2 | 4/2014 | May | |
| 8,783,376 | B2 * | 7/2014 | Congdon | E02F 3/8152 172/701.3 |
| 2005/0098332 | A1 | 5/2005 | Matsumoto et al. | |
| 2009/0321097 | A1 | 12/2009 | Matsumoto et al. | |
| 2011/0162241 | A1 | 7/2011 | Wangsness | |
| 2014/0041886 | A1 | 2/2014 | Congdon et al. | |

FOREIGN PATENT DOCUMENTS

| | | | |
|---|---|---|---|
| CN | 103180524 | | 6/2013 |
| GB | 1117386 | A | 6/1968 |
| JP | 2012-7449 | A | 1/2012 |
| JP | 2001-040692 | A | 2/2012 |
| WO | 2004044337 | | 5/2004 |
| WO | WO 2013/112102 | A1 | 8/2013 |
| WO | WO 2015/031090 | A1 | 3/2015 |

* cited by examiner

IMPLEMENT END CUTTING-BIT

TECHNICAL FIELD

This patent disclosure relates generally to ground engaging tools and, more particularly, to ground engaging tools on buckets, blades, and other work tools used with mining and construction machinery.

BACKGROUND

Different types of mining and construction machines, such as tractors, bulldozers, backhoes, excavators, motor graders, and mining trucks commonly employ earth-working blades to move and level earth or materials being excavated or loaded. The earth-working blades frequently experience extreme wear from repeated contact with highly abrasive materials encountered during operation. Replacement of the earth-working blades and other implements used in mining and construction machinery can be very costly and labor intensive.

The earth-working blades can be equipped with a ground engaging tool (GET), such as a cutting-bit or a set of cutting-bits, to help protect the blade and other earth-working tools from wear. Typically, a cutting-bit can be in the form of teeth, edge protectors, tips, or other removable components that can be attached to the areas of the blade or other tool where most damaging and repeated abrasions and impacts occur. For example, a GET in the form of edge protectors can wrap around an implement's cutting edge to help protect it from excessive wear.

In such applications, the removable cutting-bits can be subjected to wear from abrasion and repeated impact, while helping to protect the blade or other implement to which they can be mounted. When the cutting-bit becomes worn through use, it can be removed and replaced with a new cutting-bit or other GET at a reasonable cost to permit the continued use of the implement. By protecting the implement with a GET and replacing the worn GET at appropriate intervals, significant cost and time savings are possible.

The cost and time savings available from using a cutting-bit to protect large machine implements can be further enhanced by increasing the ability of the cutting-bit to cut through the working material. In many applications, a machine must make a pass using a first implement, such as a ripper or other cutting tool, to cut the earth or other working material before making another pass with a second implement, such as a blade, to move the material. Thus, an implement system able to cut the working material and move the material with a blade using fewer passes can result in increased work efficiency. There is an ongoing need in the art for an improved cutting-bit system that increases the efficiency of earth-working machinery and increases productivity.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes an implement end cutting-bit that can have a body having front, rear, top, bottom, inner side and outer side portions. The body can have a cutting edge defined along at least a portion of a bottom interface between the front portion and the bottom portion. The body can also have a substantially flat front surface defined on the front portion. The substantially flat front surface can extend between a top edge that can be disposed along a top interface between the front portion and the top portion, an outer side edge that can be disposed along an outer side interface between the front portion and the outer side portion, a ridge that can be disposed on the front portion, and a spearhead edge that can be disposed along the bottom interface between the outer side portion and the cutting edge. The body can also have a contoured front surface formed on the front portion of the body adjacent the substantially flat front surface. The contoured front surface can be defined between an inner side edge, which can be disposed along an inner side interface between the front portion and the inner side portion, the cutting edge, and the ridge.

In another embodiment, the present disclosure describes an implement end cutting-bit having a body that can have a front, rear, top, bottom, inner side and outer side portions. The body can have a cutting edge defined along at least a portion of a bottom interface between the front portion and the bottom portion. The body can have a rear surface defined on the rear portion that can define a rear surface plane. The rear surface plane can be substantially parallel to a normal-lateral plane. The body can also have a flat front surface defined on the front portion. The flat front surface can extend between a top edge that can be disposed along a top interface between the front portion and the top portion, an outer side edge that can be disposed along an outer side interface between the front portion and the outer side portion, a ridge that can be disposed on the front portion, and a spearhead edge that can be disposed along the bottom interface between the outer side portion and the cutting edge. A flat front surface plane can be defined along the flat front surface. The flat front surface plane can be disposed at an angle in a range between about 10 degrees and about 20 degrees with respect to the normal-lateral plane.

In yet another embodiment, the present disclosure describes an implement end cutting-bit system that can have at least one end cutting-bit that can be adapted to be mounted to a mounting edge of an earth-working blade. The mounting edge can be defined between a first blade end and a second blade end. The at least one end cutting-bit can include a body having front, rear, top, bottom, inner side and outer side portions. A cutting edge can be defined along at least a portion of a bottom interface between the front portion and the bottom portion. The body can also have a flat front surface that can be defined on the front portion. The flat front surface can extend between a top edge that can be disposed along a top interface between the front portion and the top portion, an outer side edge that can be disposed along an outer side interface between the front portion and the outer side portion, a ridge that can be disposed on the front portion, and a spearhead edge that can be disposed along the bottom interface between the outer side portion and the cutting edge. The body can also have a contoured front surface formed on the front portion of the body adjacent the flat front surface. The contoured front surface can be defined between an inner side edge, which can be disposed along an inner side interface between the front portion and the inner side portion, the cutting edge, and the ridge. The implement end cutting-bit system can also have at least one intermediate cutting-bit that can be adapted to be mounted along the mounting edge of the earth-working blade between the first blade end and the second blade end.

Further and alternative aspects and features of the disclosed principles will be appreciated from the following detailed description and the accompanying drawings. As will be appreciated, the principles related to end cutting-bits disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
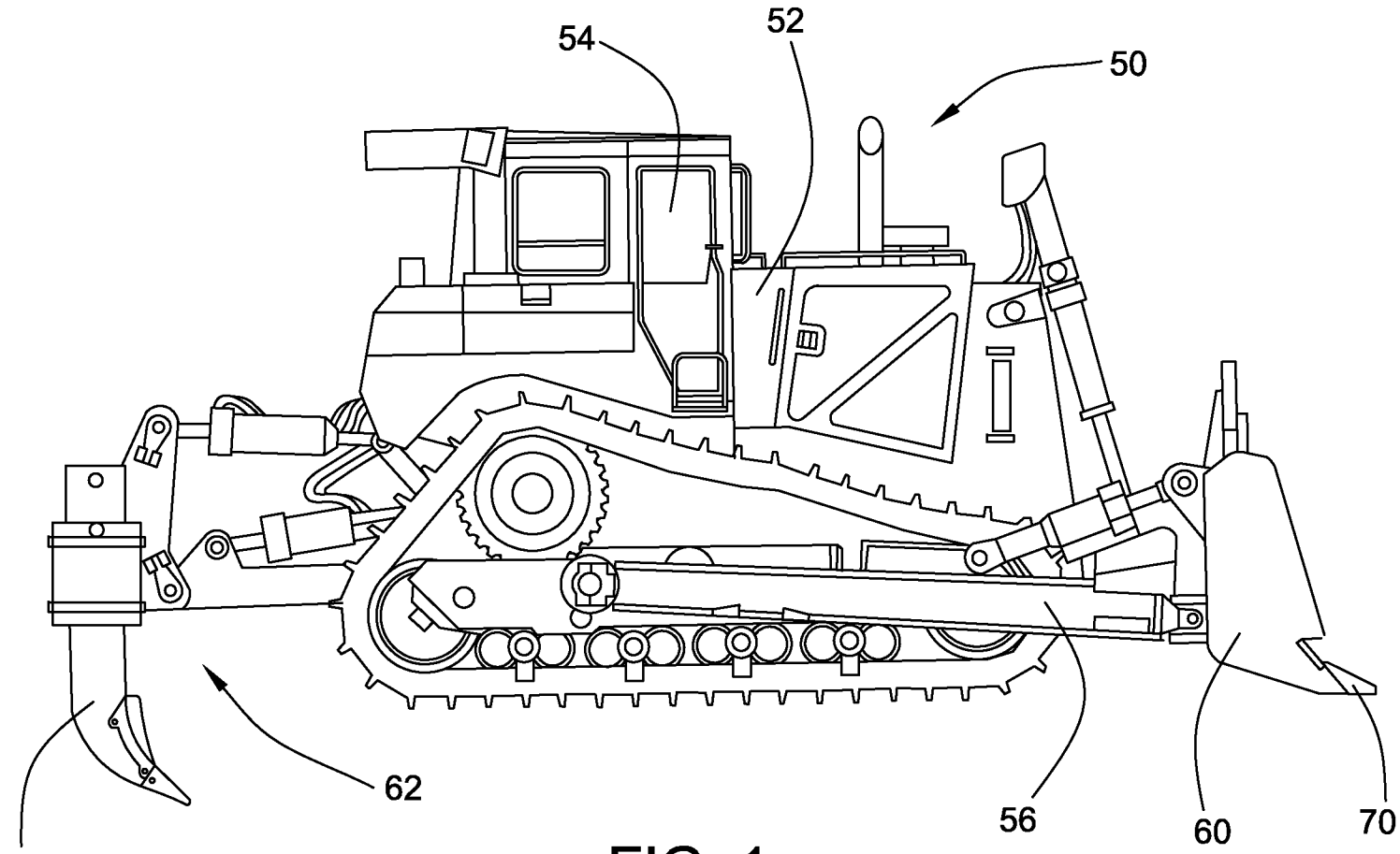
FIG. 1 is a diagrammatic side elevational view of an embodiment of a machine including an embodiment of an implement having an implement end cutting-bit constructed in accordance with principles of the present disclosure.

This disclosure relates to GET assemblies and systems, specifically implement cutting-bits, utilized in various types of mining, earth-working, and construction machinery. FIG. 1 shows an embodiment of a machine 50 in the form of a track-type tractor that can include an embodiment of an implement end cutting-bit 100 constructed in accordance with principles of the present disclosure. Among other uses, a track-type tractor can be used to move and strip working material in various surface mining or other construction applications.

As shown in FIG. 1, the machine 50 can include a body 52 with a cab 54 to house a machine operator. The machine 50 can also include an arm system 56 pivotally connected at one end to the body 52 or undercarriage and supporting an implement assembly 60 at an opposing, distal end. In embodiments, the implement assembly 60 can include any suitable implement, such as an earth-working blade, or any other type of suitable device usable with an end cutting-bit 100. The illustrated machine 50 also includes a ripper assembly 62 having a ripper 64 opposite the implement assembly 60. The ripper 64 can be used to cut through and break up working material for removal. A control system can be housed in the cab 54 that can be adapted to allow a machine operator to manipulate and articulate the implement assembly 60 and/or the ripper assembly 62 for digging, excavating, or any other suitable application.

Figure 2:
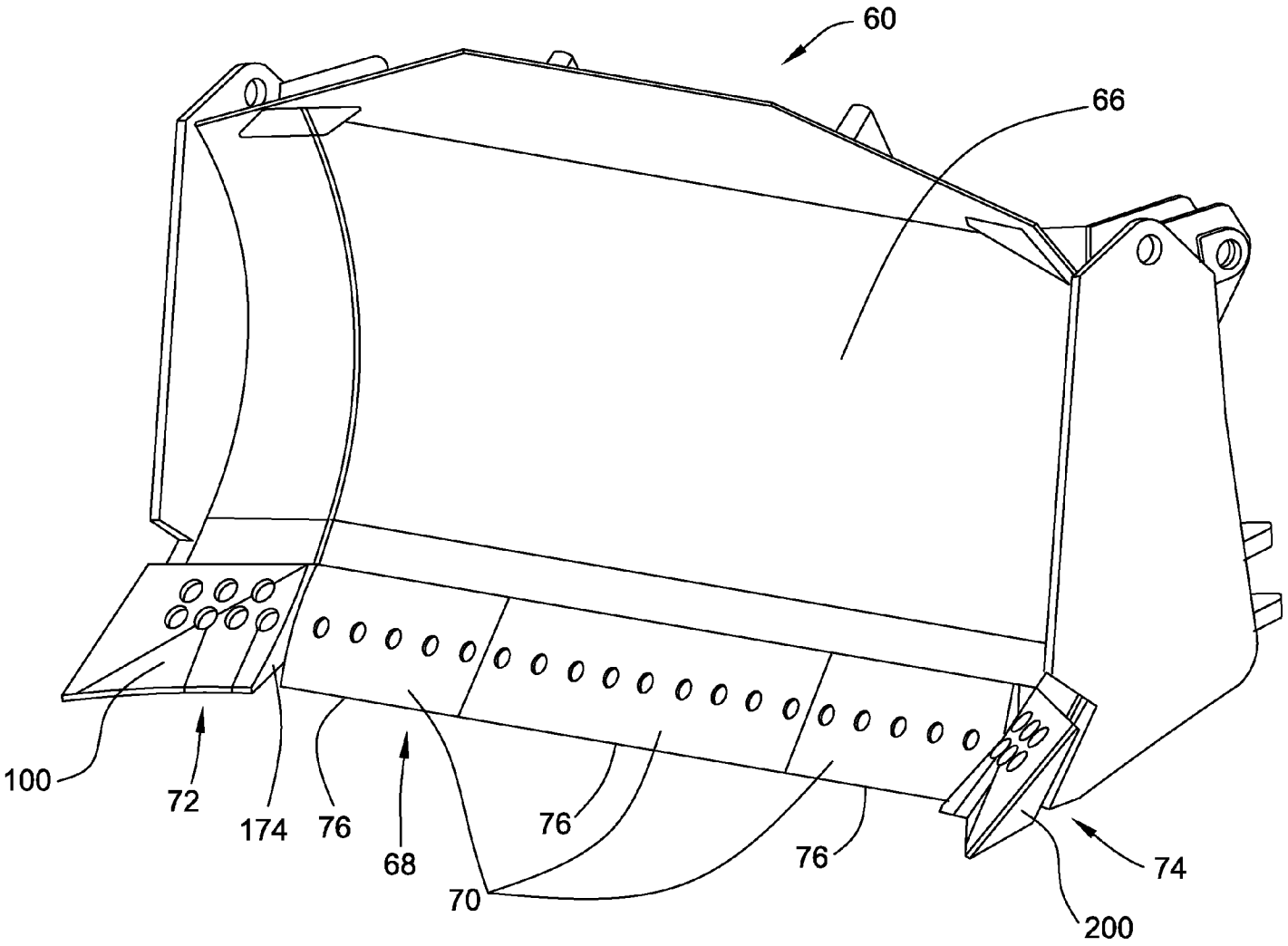
FIG. 2 is a perspective view of the implement of FIG. 1.

FIG. 2 shows an embodiment of the implement assembly 60. Referring to FIG. 2, the implement assembly 60 can include an earth-working blade 66 that can have a mounting edge 68 adapted to engage the ground or other excavation surface. The mounting edge 68 can be adapted to receive a plurality of cutting-bits, including both intermediate cutting-bits 70 and end cutting-bits 100, 200. The end cutting-bits 100, 200 can be arranged on the mounting edge 68 at a first blade end 72 and a second blade end 74, respectively. In some embodiments, the end cutting-bit 100 mounted to the first blade end 72 of the mounting edge 68 can be symmetrical to the end cutting-bit 200 mounted to the second blade end 74 of the mounting edge 68. In the illustrated embodiment, the intermediate cutting-bits 70 can be mounted along the mounting edge 68 between the end cutting-bits 100, 200. Each intermediate cutting-bit 70 can have a cutting edge 76 that can contact the working material during machine operation. Although FIG. 2 illustrates three intermediate cutting-bits 70, it is contemplated that any number of intermediate cutting-bits of varying shapes and sizes can be used. In some embodiments, it is contemplated that no intermediate cutting-bits are used. Through repeated use, the end cutting-bits 100, 200 and the intermediate cutting-bits 70 can be subjected to wear and eventually can be replaced to allow the further use of the implement assembly 60.

Although FIGS. 1 and 2 illustrate the use of an end cutting-bit constructed in accordance with principles of the present disclosure with blade of a track-type tractor, many other types of implements and mining and construction machinery can benefit from using an end cutting-bit as described herein. It should be understood that, in other embodiments, an end cutting-bit constructed in accordance with principles of the present disclosure can be used in a variety of other implements and/or machines.

Figure 3:
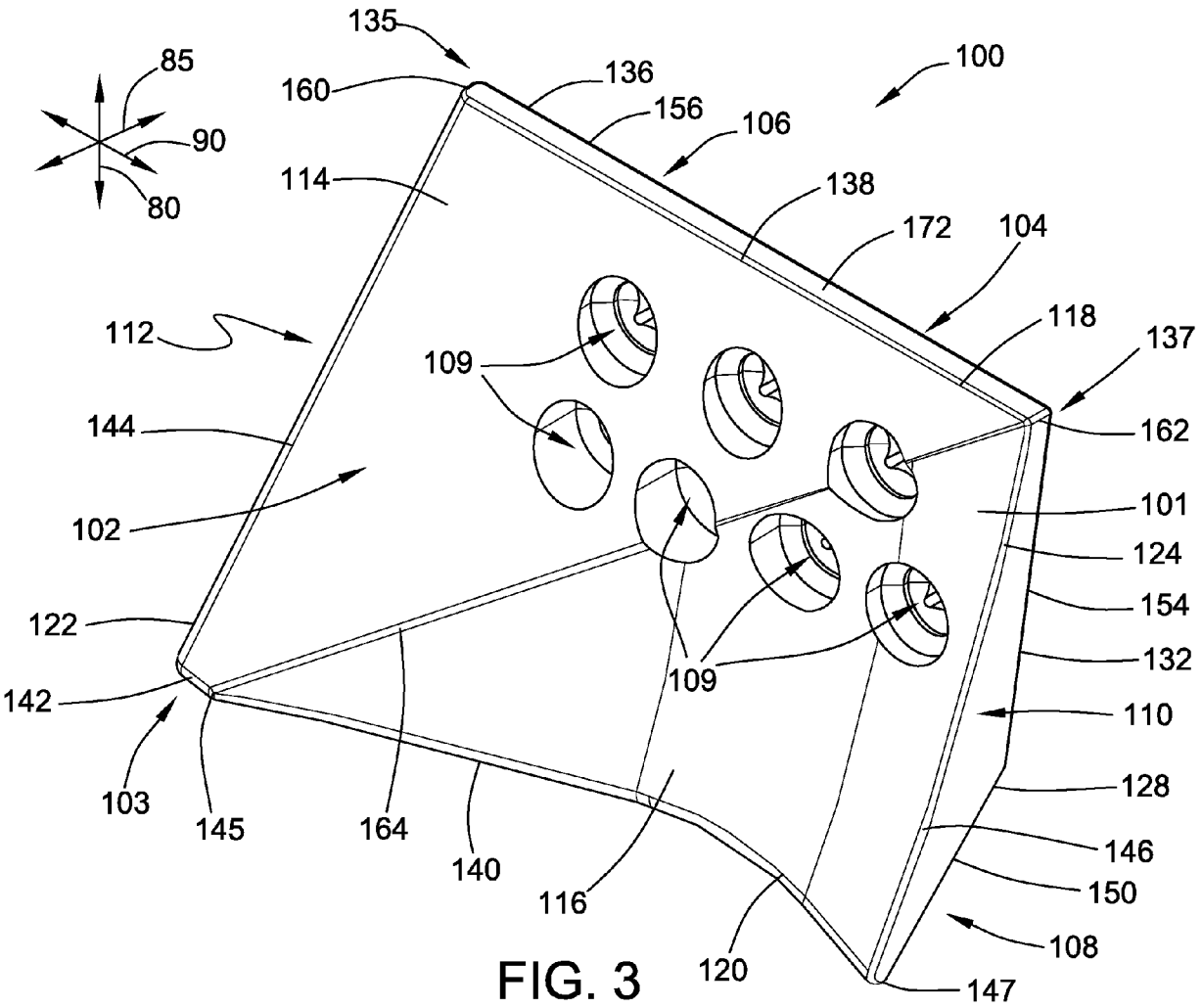
FIG. 3 is a front-right perspective view of an implement end cutting-bit constructed in accordance with the principles of the present disclosure.
Figure 4:
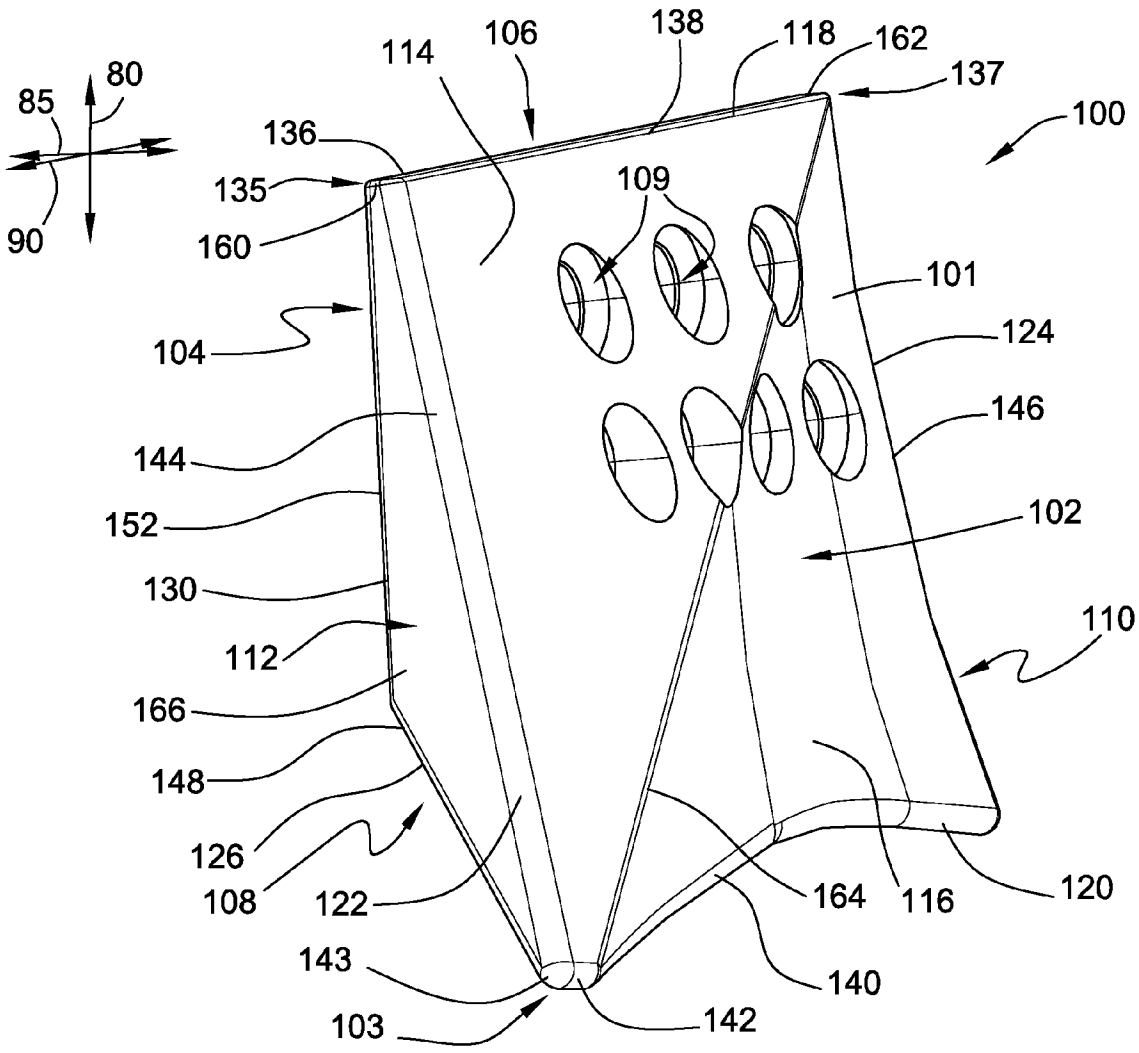
FIG. 4 is a front-left perspective view of the implement end cutting-bit of FIG. 3.
Figure 5:
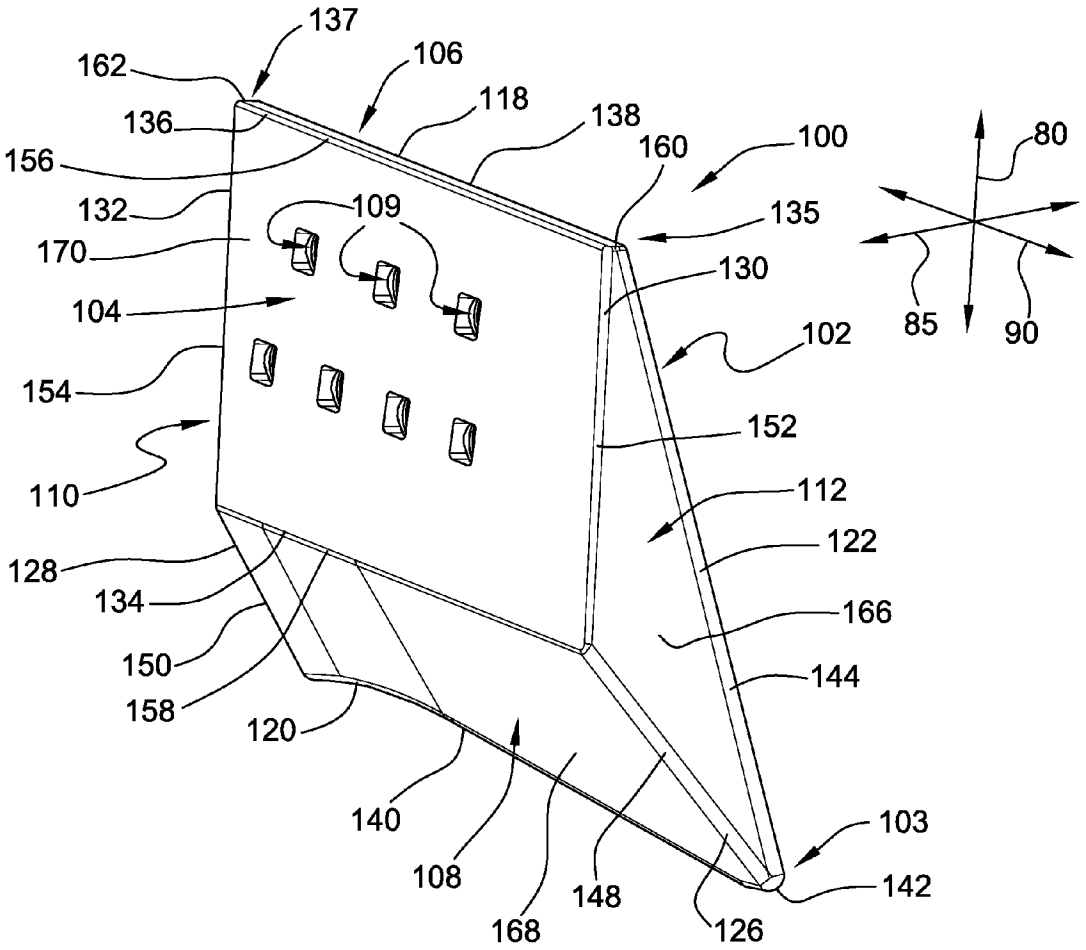
FIG. 5 is a rear-left perspective view of the implement end cutting-bit of FIG. 3.

FIGS. 3-5 illustrate perspective views of an embodiment of an end cutting-bit 100. The end cutting-bit 100 can be formed from a body 101 that can have a generally trapezoidal shape with a spearhead protrusion 103 on one corner. The shape of the end cutting-bit 100 disclosed herein with the spearhead protrusion 103 provides various benefits that improve the speed and efficiency in which a machine can excavate or clear work material. Specifically, the disclosed shape of the end cutting-bit 100 cuts through the surface of a work material such that a machine 50 equipped with a blade 66 having the disclosed end cutting-bit 100 can cut through and clear work material on a single pass. Such capability is an improvement over prior GET assemblies that require a machine to make a first pass using a ripper or other ground-cutting tool to break up the surface of the work material, then make a second pass with a blade or other implement to clear away the work material. Therefore, the disclosed end cutting-bit 100 can substantially reduce the number of passes required by an earth-clearing machine to clear an area, reducing the number of passes by up to half in some applications.

The body 101 can have a front portion 102, a rear portion 104, a top portion 106, a bottom portion 108, an inner side portion 110, and an outer side portion 112. Interfaces can exist between each of the adjacent portions. Specifically, a top interface 118 can exist between the top portion 106 and the front portion 102, and a bottom interface 120 can exist between the front portion and the bottom portion 108. An outer side interface 122 can exist between the front portion 102 and the outer side portion 112, and an inner side interface 124 can exist between the front portion and the inner side portion 110. An outer bottom interface 126 can exist between the bottom portion 108 and the outer side portion 112, and an inner bottom interface 128 can exist between the inner side portion 110 and the bottom portion. Additionally, an outer rear interface 130 can exist between the outer side portion 112 and the rear portion 104, and an inner rear interface 132 can exist between the inner side portion 110 and the rear portion. A rear bottom interface 134 can exist between the rear portion 104 and the bottom portion 108, and a rear top interface 136 can exist between the top portion 106 and the rear portion. Finally, in some embodiments, an outer top interface 135 can exist between the outer side portion 112 and the top portion 106, and an inner top interface 137 can exist between the inner side portion 110 and the top portion.

In some embodiments, a plurality of mounting orifices 109 can be formed in the body 101, creating passages between the front portion 102 and the rear portion 104 of the body. The mounting orifices 109 can be adapted to receive mounting hardware, such as bolts, screws, rivets, or other mounting tools suitable to secure the end cutting-bit 100 to an implement. In some embodiments, the mounting orifices 109 can be countersunk to provide a smooth, flush surface on the front portion 102. While the illustrated embodiments show seven mounting orifices 109 adapted to receive seven sets of mounting hardware, it is contemplated that any number of mounting orifices can be used in other embodiments. It is also contemplated that alternative mounting methods can be used to mount the end cutting-bit 100 to an earth-working blade or other implement.

Each interface on the body 101 can define one or more edges that can define surfaces on the body. Specifically, a top edge 138 can be disposed along the top interface 118, and a cutting edge 140 can be disposed along at least a portion of the bottom interface 120 between the inner side portion 110 and the spearhead protrusion 103. In some embodiments, the cutting edge 140 can curve concavely away from the front portion 102, defining an edge that curves away from the spearhead protrusion 103. A spearhead edge 142 can also be disposed along the bottom interface 120 between the outer side portion 112 and the cutting edge 140, which can form the forward edge of the spearhead protrusion 103. An outer side edge 144 can be disposed along the outer side interface 122 between the top edge 138 and the spearhead edge 142, and an inner side edge 146 can be disposed along the inner side interface 124 between the top edge 138 and the cutting edge 140. Additionally, the body 101 can include an outer bottom edge 148 disposed along the outer bottom interface 126 between the spearhead edge 142 and the rear portion 104, and an inner bottom edge 150 disposed along the inner bottom interface 128 between the cutting edge 140 and the rear portion. An outer rear edge 152 can be disposed along the outer rear interface 130 between the top portion 106 and the outer bottom edge 148, and an inner rear edge 154 can be disposed along the inner rear interface 132 between the top portion and the inner bottom edge 150. A rear top edge 156 can be disposed along the rear top interface 136 between the outer rear edge 152 and the inner rear edge 154, and a rear bottom edge 158 can be disposed along the rear bottom interface 134 between the outer rear edge and the inner rear edge. Further, in some embodiments, an outer top edge 160 can be defined along the outer top interface 135 between the top edge 138 and the rear top edge 156, and an inner top edge 162 can be defined along the inner top interface 137 between the top edge and the rear top edge. In the illustrated embodiments, the various edges can be chamfered to form rounded edges and corners to the body 101. It is contemplated, however, that the edges of the body 101 can have sharp corners, angled bevels, or any other suitable shape.

For the purpose of illustration, the figures indicate a normal axis 80, a lateral axis 90, and a longitudinal axis 85, all of which are defined perpendicular to one another. In FIGS. 3-5, for the purposes of illustration, the body 101 of the end cutting-bit 100 is aligned such that the outer top edge 160 and the inner top edge 162 can extend substantially along the longitudinal axis 85, and the top edge 138 can extend substantially along the lateral axis 90.

As best shown in FIGS. 3-4, the front portion 102 of the body 101 can define an at least substantially flat front surface 114 and a contoured front surface 116. A ridge 164 can also be disposed on the front portion 102 separating the flat front surface 114 from the contoured front surface 116. In some embodiments, such as the embodiment illustrated in FIG. 6, the ridge 164 can extend along the front portion 102 between the inner top edge 162 and the spearhead edge 142. The flat front surface 114 can extend between the top edge 138, the outer side edge 144, the ridge 164, and the spearhead edge 142. The contoured front surface 116 can form a generally triangular concave depression on the front portion 102 of the body 101 adjacent the flat front surface 114. The generally concave shape of the contoured front surface 116 can help in directing work material debris away from the spearhead protrusion 103 as the end cutting-bit passes through the work material. This can reduce work material build-up at the point of the end cutting-bit 100 that engages the work material, which can improve cutting and clearing efficiency. It is contemplated, however, that the contoured front surface 116 can have other shapes in other embodiments. The contoured front surface 116 can extend between the ridge 164, the inner side edge 146, and the cutting edge 140. In some embodiments, the end cutting-bit 100 can be mounted to an implement adjacent the intermediate cutting-bits 70 along the inner side portion 110 of the body 101. If desired, the shape and curvature of the contoured front surface 116 and the cutting edge 140 can vary in different embodiments of the end cutting-bit 100 depending on the dimensions of the particular intermediate cutting-bit used to ensure a smooth transition between the adjacent cutting-bits. Although the illustrated embodiments do not show a smooth transition between the end cutting-bits 100, 200 and the intermediate cutting-bits 70, it is contemplated that such a smooth transition can occur by varying the dimensions of the end cutting-bit.

The body 101 can also include an outer spearhead corner 143 and an inner spearhead corner 145. The outer spearhead corner 143 can be disposed at the junction between the outer side edge 144 and the spearhead edge 142, and the inner spearhead corner 145 can be disposed at the junction between the ridge 164, the spearhead edge 142, and the cutting edge 140. Additionally, the body 101 can include an inner side corner 147 disposed at the junction between the cutting edge 140, the inner side edge 146, and the inner bottom edge 150.

FIGS. 4-5 illustrate an outer side surface 166 that can be defined on the outer side portion 112 of the body 101. The outer side surface 166 can be disposed on the body 101 adjacent the flat front surface 114 and extend between the outer side edge 144, the outer rear edge 152, and the outer bottom edge 148. In some embodiments, the outer side surface 166 can be flat; however, it is contemplated that the outer side surface can be non-flat in some embodiments.

Figure 12:
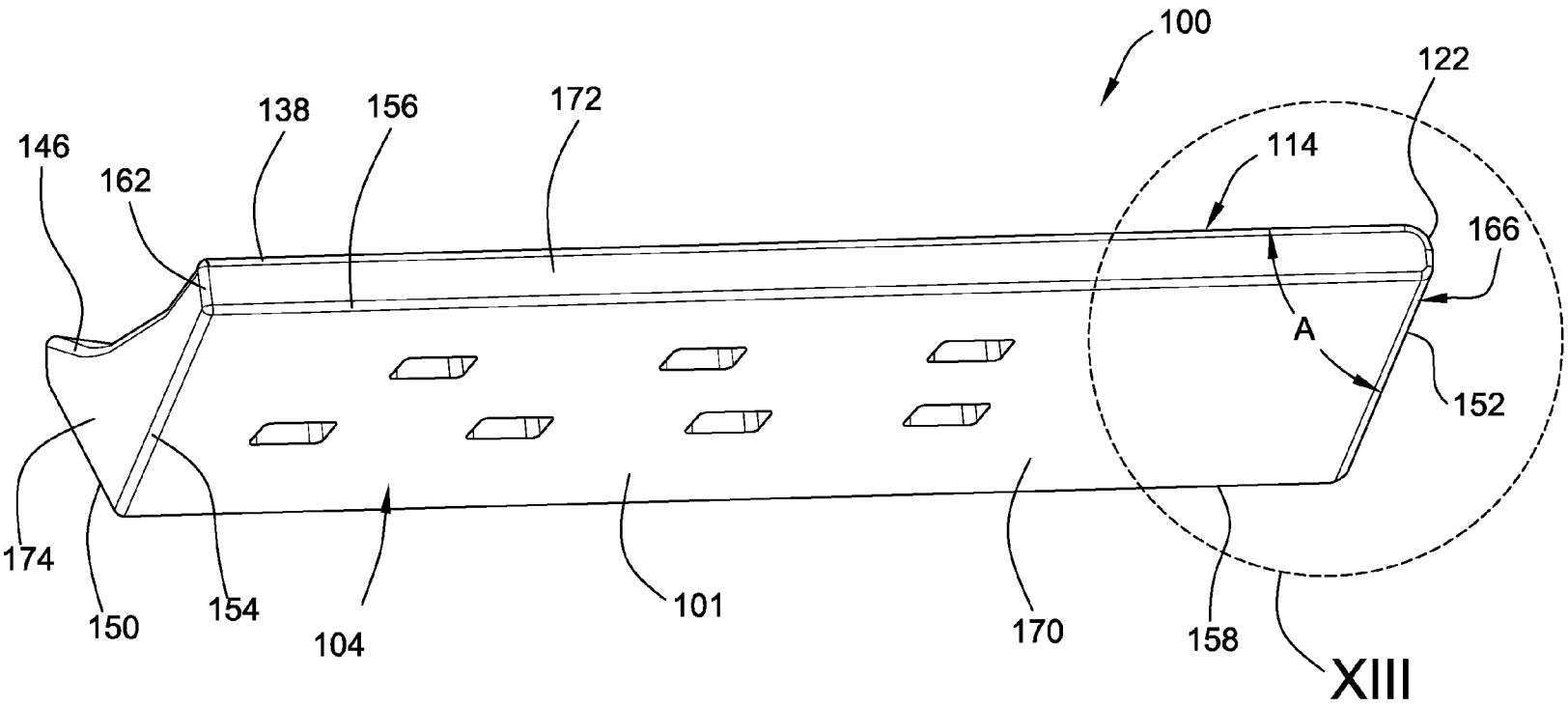
FIG. 12 is a rear-top perspective view substantially aligned with a flat front surface and an outer side surface of the implement end cutting-bit of FIG. 3.
Figure 13:
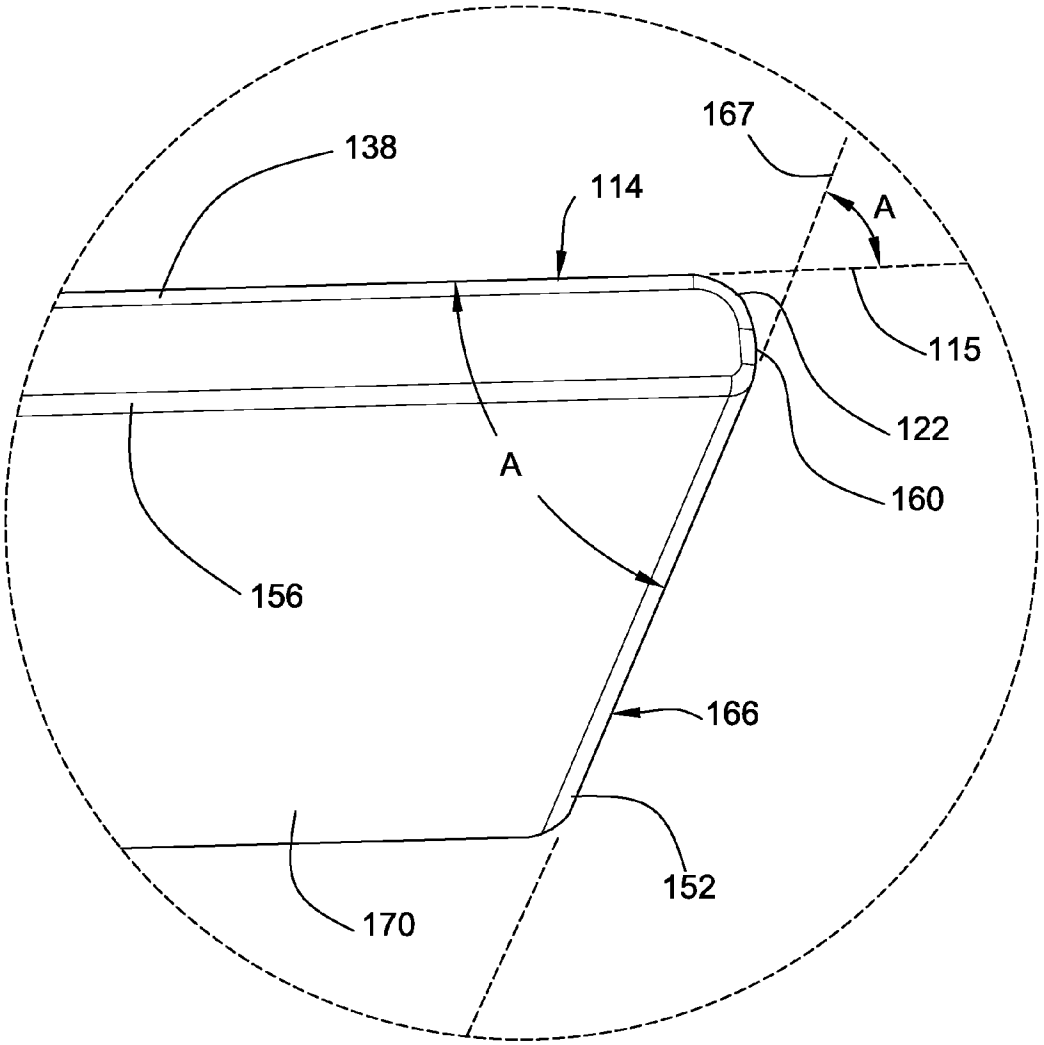
FIG. 13 is an enlarged, detail view taken from FIG. 12 as indicated by circle XIII.

FIG. 12 illustrates the intersection of the flat front surface 114 and the outer side surface 166 along the outer side interface 122. As best shown in FIG. 13, the outer side surface 166 can define an outer side surface plane 167, and the flat front surface 114 can define a flat front surface plane 115. The intersection of the flat front surface plane 115 and the outer side surface plane 167 can define an outer side angle A measured about the outer side interface 122. The outer side angle A can represent the angle formed between the flat front surface 114 and the outer side surface 166 with respect to the outer side interface 122. In some embodiments, the outer side angle A, measured with respect to the outer side interface 122, can be less than about 90 degrees. In other embodiments, the outer side angle A can be in a range between about 35 degrees and about 80 degrees. In yet other embodiments, the outer side angle A can be in a range from about 50 degrees to about 70 degrees. The nature of the outer side angle A can allow for the end cutting-bit 100 to more effectively and efficiently cut through a working material as the machine 50 makes a pass in a work area. In embodiments in which the outer side angle A can be less than 90 degrees, a relief area can formed behind the portion of the flat front surface 114 adjacent the outer side surface 166 as the end cutting-bit 100 passes through the work material. Debris cut from the surface of the work material can then be allowed to pass around the flat front surface 114 of the body 101 and into the relief area, increasing cutting efficiency.

Figure 11:
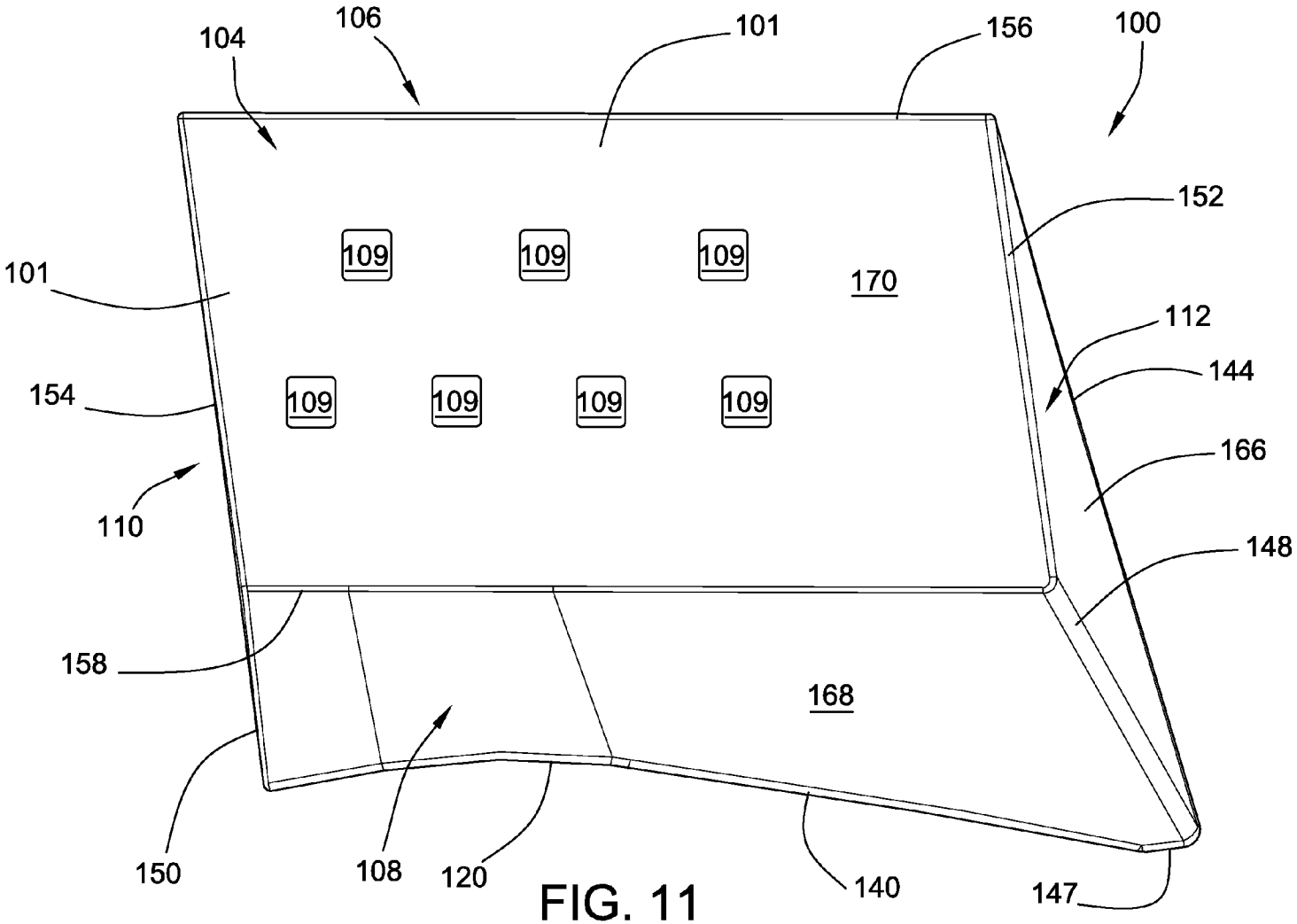
FIG. 11 is a rear view of the implement end cutting-bit of FIG. 3.

As illustrated in FIGS. 5 and 11, a bottom surface 168 can be defined on the bottom portion 108 of the body 101 and a rear surface 170 can be defined on the rear portion 104 of the body. The bottom surface 168 can be disposed on the body 101 adjacent the outer side surface 166 along the outer bottom edge 148. The bottom surface 168 further extends between the cutting edge 140, the spearhead edge 142, the inner bottom edge 150, and the rear bottom edge 158. In some embodiments, the bottom surface 168 is planar, while in other embodiments the bottom surface can be contoured or be made up of multiple planar surfaces. The rear surface 170 can be disposed on the rear portion 104 of the body 101 adjacent the bottom surface 168 along the rear bottom edge 158. Although the rear bottom edge 158 is illustrated as substantially linear in the illustrated embodiments, it is contemplated that the rear bottom edge can be non-linear in some embodiments. The rear surface 170 can extend between the rear bottom edge 158, the outer rear edge 152, the inner rear edge 154, and the rear top edge 156, forming a substantially trapezoidal surface in some embodiments.

Figure 14:
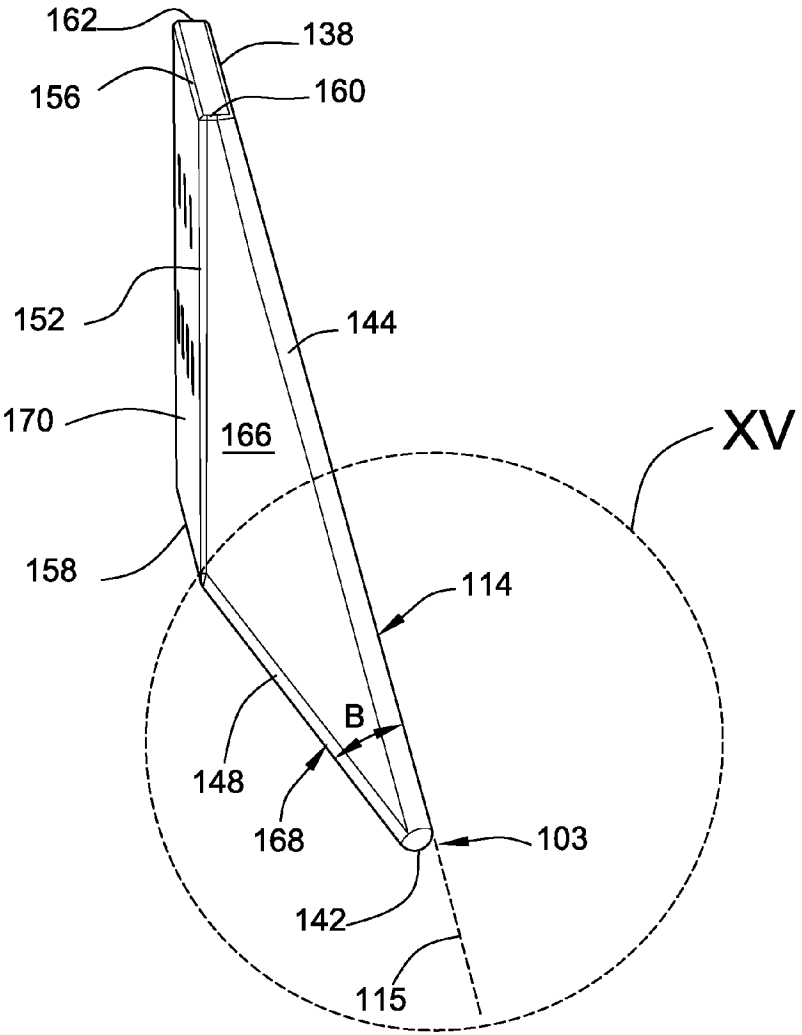
FIG. 14 is a rear-side perspective view substantially aligned with a flat front surface and a bottom surface of the implement end cutting-bit of FIG. 3.
Figure 15:
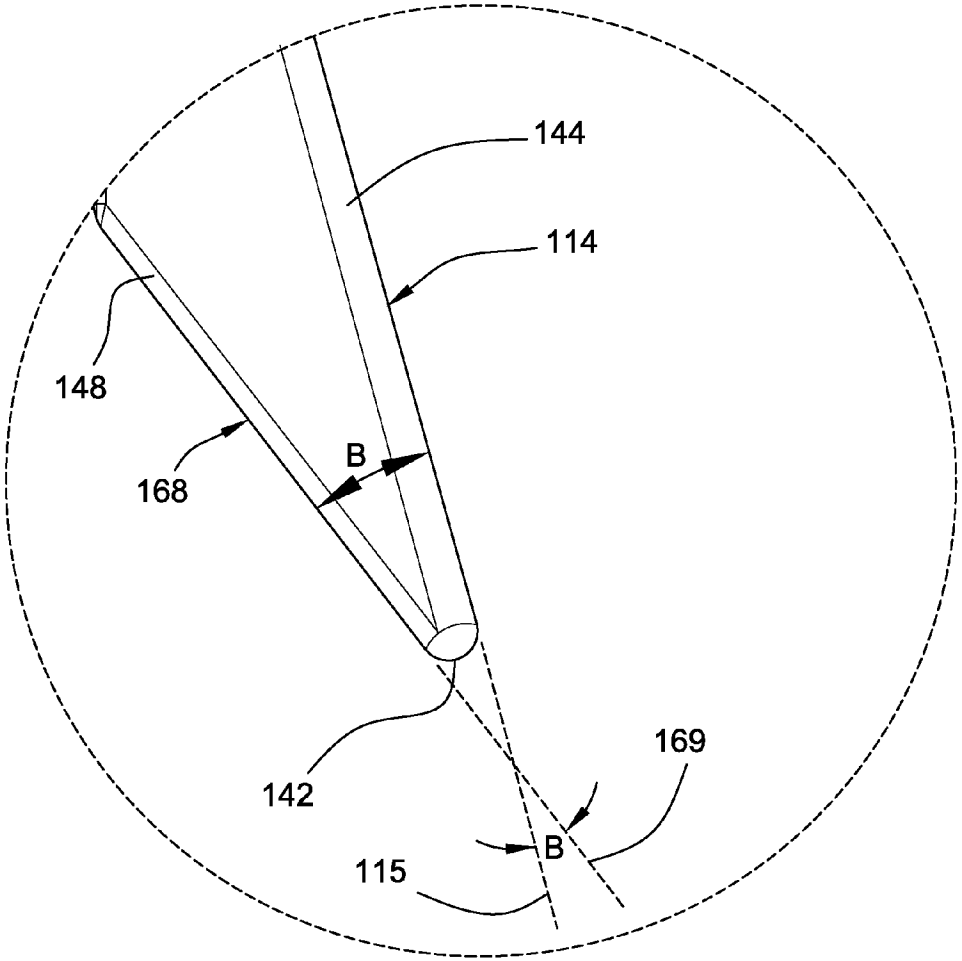
FIG. 15 is an enlarged, detail view taken from FIG. 14 as indicated by circle XV.

The bottom surface 168 can intersect the flat front surface 114 along the bottom interface 120 at the spearhead edge 142. FIG. 14 illustrates the intersection of the flat front surface 114 and the bottom surface 168 along the spearhead edge 142. At least a portion of bottom surface 168 can define a bottom surface plane 169 that can intersect the flat front surface plane 115, as illustrated in FIG. 15. The intersection of the flat front surface plane 115 and the bottom surface plane 169 can define a spearhead edge angle B measured about the spearhead edge 142. The spearhead edge angle B can represent the angle formed between the flat front surface 114 and the bottom surface 168 with respect to the spearhead edge 142. In some embodiments, the spearhead edge angle B can be less than about 90 degrees. In other embodiments, the spearhead edge angle B can be less than about 60 degrees. In other embodiments, the spearhead edge angle B can be in a range between about 10 degrees and about 45 degrees. In yet other embodiments, the spearhead edge angle B can be in a range between about 15 degrees and about 30 degrees. The nature of the spearhead edge angle B can allow for the end cutting-bit 100 to more effectively and efficiently cut through a working material as the machine 50 makes a pass in a work area. In embodiments in which the spearhead edge angle B can be less than 90 degrees, a relief area can formed behind the portion of the flat front surface 114 adjacent the bottom surface 168 as the end cutting-bit 100 passes through the work material. Debris cut from the surface of the work material can then be allowed to pass under the spearhead edge 142 or around the outer side surface 166 adjacent the flat front surface 114 of the body 101 and into the relief area, increasing cutting efficiency.

Figure 7:
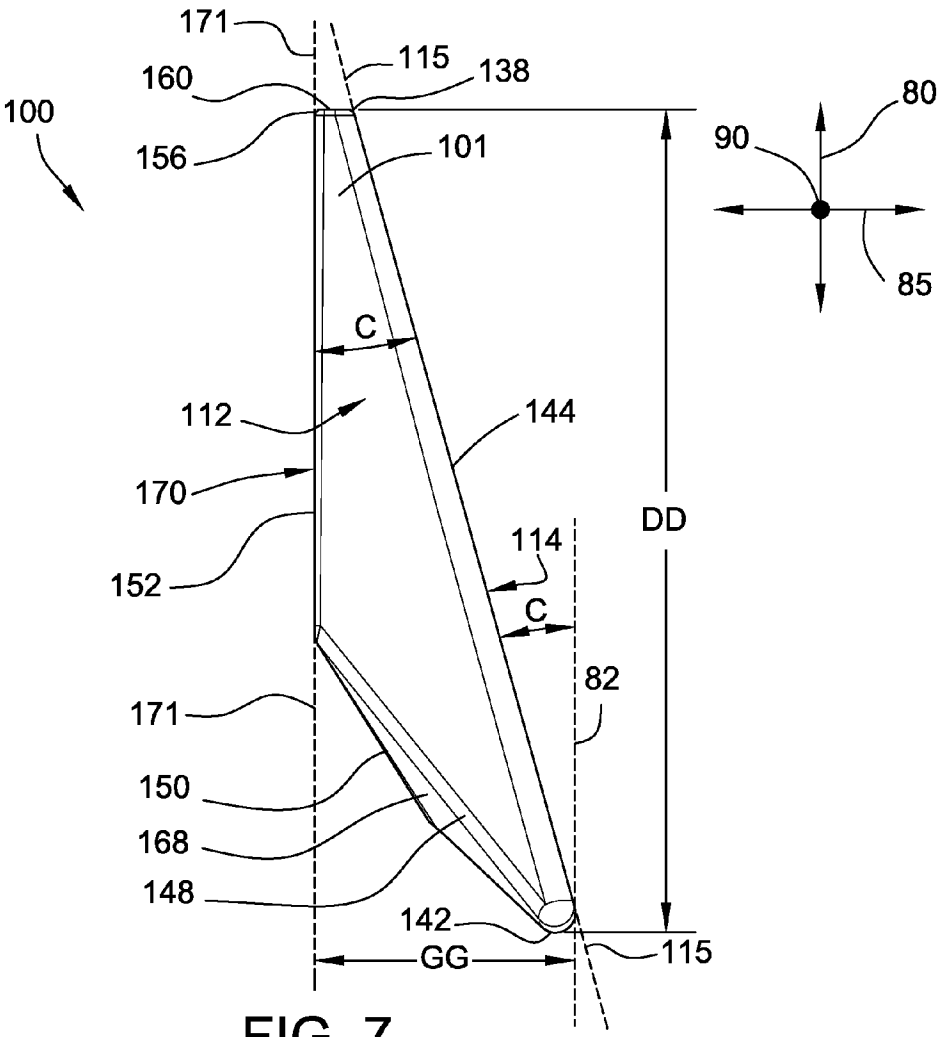
FIG. 7 is a left side elevational view of the implement end cutting-bit of FIG. 3.

Referring now to FIG. 7, the body 101 of the end cutting-bit 100 can be aligned such that the outer top edge 160 extends substantially along the longitudinal axis 85, and the top edge 138 extends along the lateral axis 90. In such an alignment, a flat front surface angle C can be formed between the flat front surface plane 115 and a normal-lateral plane 82, which is the plane defined by the normal axis 80 and the lateral axis 90. In the embodiment illustrated in FIG. 7, the rear surface 170 can define a rear surface plane 171 parallel to the normal-lateral plane 82. In such an embodiment, the flat front surface angle C can be equivalent to the angle formed between the flat front surface plane 115 and the rear surface plane 171. In some embodiments, the flat front surface angle C can be less than about 30 degrees. In other embodiments, the flat front surface angle C can be less than about 20 degrees. In some embodiments, the flat front surface angle C can be in a range between about 5 degrees and about 30 degrees. In yet other embodiments, the flat front surface angle C can be in a range between about 10 degrees to about 20 degrees.

Figure 8:
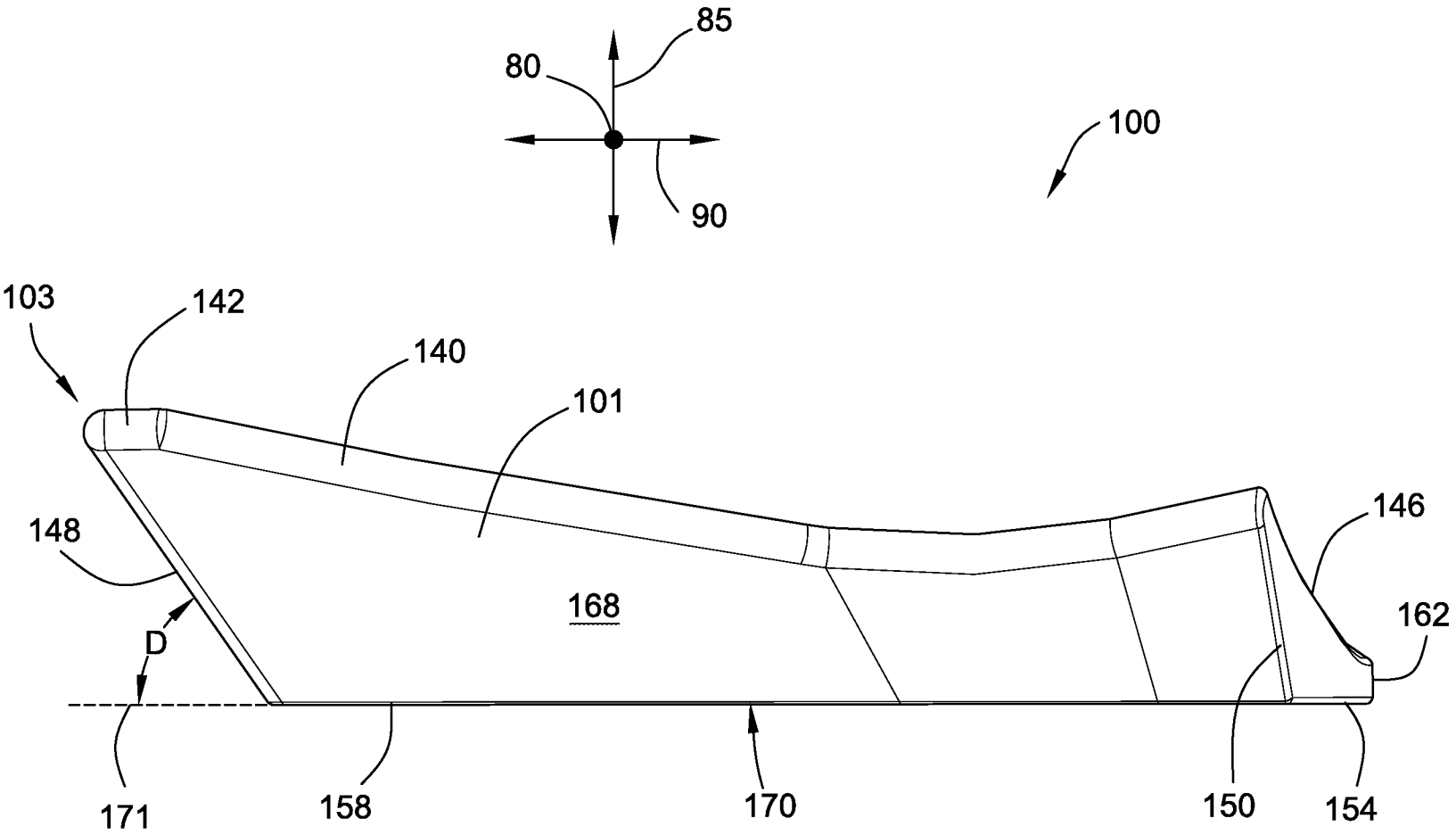
FIG. 8 is a bottom view of the implement end cutting-bit of FIG. 3.
Figure 9:
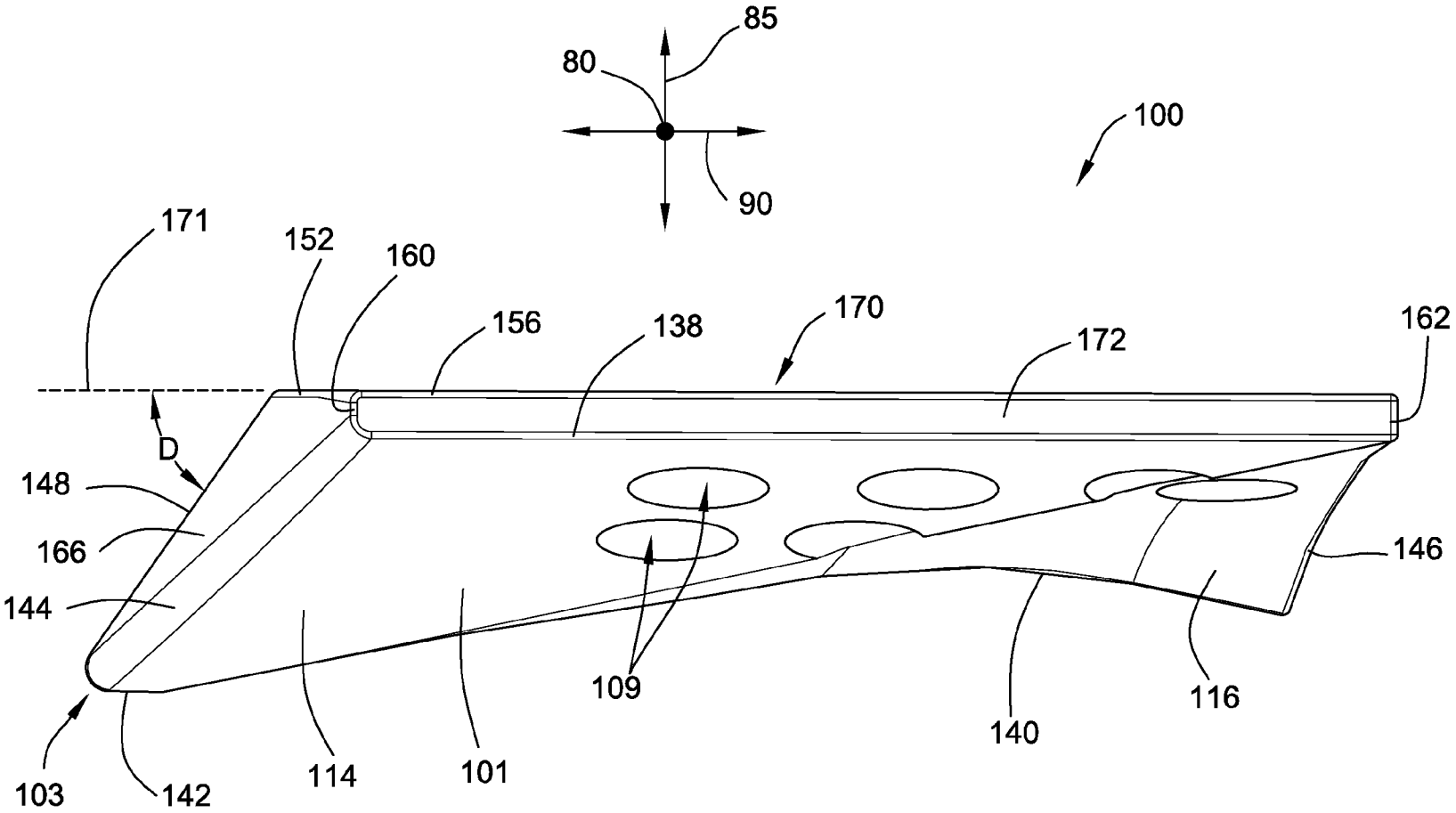
FIG. 9 is a top plan view of the implement end cutting-bit of FIG. 3.

Referring now to FIG. 8, the illustrated embodiment of the body 101 of the end cutting-bit 100 is shown with the rear bottom edge 158 extending substantially along the lateral axis 90, and the inner top edge 162 extending substantially along the longitudinal axis 85. In such an alignment, an outer bottom edge angle D is formed between the rear surface plane 171 and the outer bottom edge 148 in a plane defined by the longitudinal axis 85 and the lateral axis 90. The outer bottom edge angle D is also illustrated in FIG. 9. In some embodiments, the outer bottom edge angle D can be less than about 90 degrees, and less than about 70 degrees in other embodiments. In some embodiments, the outer bottom edge angle D can be in a range between about 35 degrees and about 75 degrees. In yet other embodiments, the outer bottom angle D can be in a range between about 45 degrees and about 60 degrees.

FIG. 9 also illustrates a top surface 172, which can be adjacent the flat front surface 114 along the top edge 138 and adjacent the rear surface 170 along the rear top edge 156. The top surface 172 can also extend between top edge 138, the rear top edge 156, the outer top edge 160, and the inner top edge 162. In some embodiments, the top surface 172 can be a flat surface formed on the body 101 in a lateral-longitudinal plane 87, which is the plane defined by the lateral axis 90 and the longitudinal axis 85. It is contemplated, however, that the top surface 172 can have a non-flat shape in other embodiments.

Figure 10:
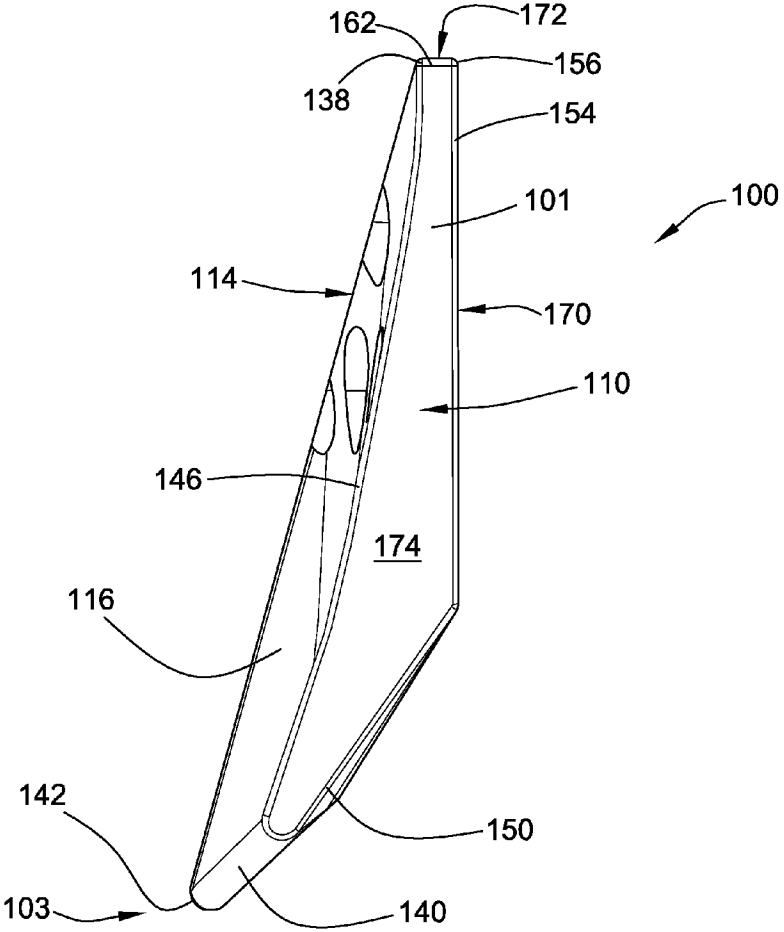
FIG. 10 is right side elevational view of the implement end cutting-bit of FIG. 3.

Referring now to FIG. 10, an inner side surface 174 can be formed on the inner side portion 110 of the body 101. The inner side surface 174 can be disposed adjacent the contoured front surface 116 along the inner side edge 146. The inner side surface 174 can extend between the inner side edge 146, the inner top edge 162, the inner rear edge 154, and the inner bottom edge 150. In the illustrated embodiment, the inner side surface 174 can be substantially flat with a substantially trapezoidal shape; however, it is contemplated that the inner side surface can be non-flat and non-trapezoidal in other embodiments. As illustrated in FIG. 2, in some embodiments, the inner side surface 174 can abut or nearly abut against an adjacent intermediate cutting-bit 70 when the end cutting-bit 100 is mounted to a blade or other implement.

The figures and drawings disclosed herein illustrate various features of an embodiment of the end cutting-bit 100 having relative lengths and angle measurements. It should be understood, however, that the dimensions disclosed are not exhaustive and other suitable dimensions are contemplated.

Figure 6:
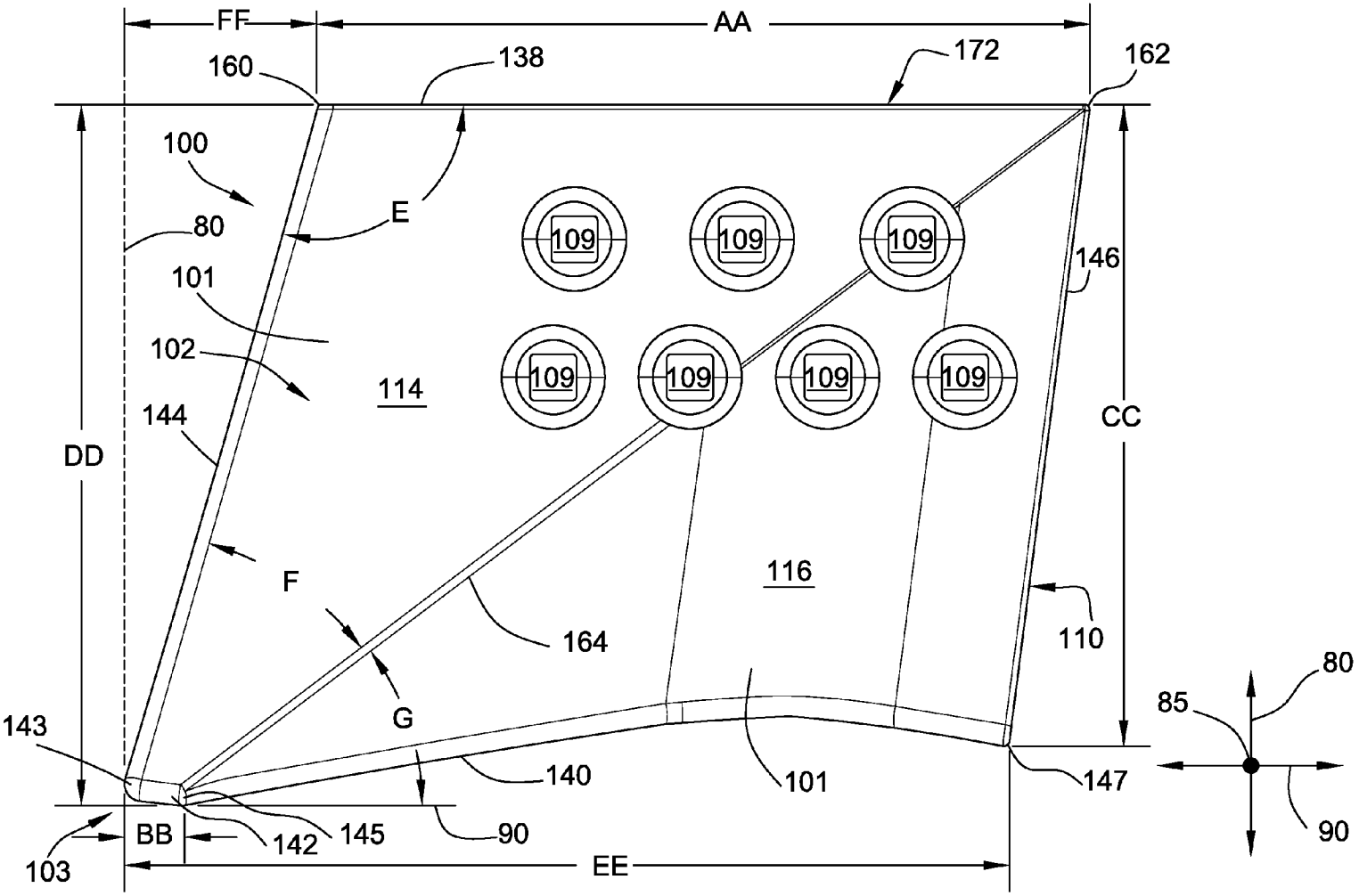
FIG. 6 is a front view of the implement end cutting-bit of FIG. 3.

FIG. 6 illustrates the body 101 of the end cutting-bit 100 aligned such that the top edge 138 extends substantially along the lateral axis 90 and the inner top edge 162 extends substantially along the longitudinal axis 85. In such an alignment, an outer side edge angle E can be formed between the outer side edge 144 and the top edge 138 in a normal-lateral plane, which is a the plane defined by the normal axis 80 and the lateral axis 90. In some embodiments, the outer side angle E can be greater than 90 degrees. In other embodiments, the outer side angle E can be greater than 100 degrees. In some embodiments, the outer side angle E can be in a range between about 90 degrees and about 120 degrees. In yet other embodiments, the outer side angle E can be in a range between about 100 degrees and about 120 degrees.

FIG. 6 also illustrates a spearhead surface angle F formed between the outer side edge 144 and the ridge 164 in the normal-lateral plane. In some embodiments, the spearhead surface angle F can be less than 55 degrees, and can be less than 45 degrees in other embodiments. In other embodiments, the spearhead surface angle F can be in a range between about 20 degrees and about 50 degrees. In yet other embodiments, the spearhead surface angle F can be in a range between about 30 degrees and about 40 degrees.

A ridge angle G can be formed in the normal-lateral plane between the ridge 164 and the lateral axis 90 when the body 101 is aligned such that the top edge 138 extends substantially along the lateral axis and the inner top edge 162 extends substantially along the longitudinal axis 85. In some embodiments, the ridge angle G can be less than 50 degrees, and can be less than 45 degrees in other embodiments. In some embodiments, the ridge angle G can be in a range between about 20 degrees and about 50 degrees. In yet other embodiments, the ridge angle G can be in a range between about 30 degrees and about 40 degrees.

As illustrated in FIG. 6, the top edge 138 can extend substantially along the lateral axis 90 with a top edge length AA defined as the distance along the lateral axis between the outer top edge 160 and the inner top edge 162. The spearhead edge 142 can have a spearhead edge length BB defined as the distance along the lateral axis 90 between the inner spearhead corner 145 and the outer spearhead corner 143. In some embodiments, a ratio between the spearhead edge length BB and the top edge length AA can be less than about 1:5. In other embodiments, a ratio between the spearhead edge length BB and the top edge length AA can be less than about 1:10. In some embodiments, a ratio of the spearhead edge length BB to the top edge length AA can be in a range between about 1:10 and about 1:20. In other embodiments, a ratio of the spearhead edge length BB to the top edge length AA can be in a range between about 1:10 and about 1:15. In other embodiments, a ratio of the spearhead edge length BB to the top edge length AA can be in a range between about 1:11 and about 1:13.

The body 101 can have an inner side height CC measured as the distance along the normal axis 80 between the inner top edge 162 and the inner side corner 147. The body 101 can also have an outer side height DD measured as the distance along the normal axis 80 between the outer top edge 160 and the outer spearhead corner 143. In some embodiments, a ratio of the inner side height CC to the outer side height DD can be less than about 1:1. In some embodiments, a ratio of the inner side height CC to the outer side height DD can be in a range from about 3:4 to about 1:1. In other embodiments, a ratio of the inner side height CC to the outer side height DD can be in a range from about 9:10 to about 1:1. In some embodiments, a ratio of the outer side height DD to the top edge length AA can be less than about 3:2. In other embodiments, a ratio of the outer side height DD to the top edge length AA can be less than about 1:1. In yet other embodiments, a ratio of the outer side height DD to the top edge length AA can be less than about 9:10. In some embodiments, a ratio of the outer side height DD to the top edge length AA can be in a range between about 1:2 and about 3:2. In other embodiments, a ratio of the outer side height DD to the top edge length AA can be in a range between about 3:4 and about 1:1. In yet other embodiments, a ratio of the outer side height DD to the top edge length AA can be in a range between about 17:20 and about 19:20.

The body can have a bottom length EE measured as the distance along the lateral axis 90 between the outer spearhead corner 143 and the inner side corner 147. In some embodiments, a ratio of the top edge length AA to the bottom length EE can be less than about 3:2. In other embodiments, a ratio of the top edge length AA to the bottom length EE can be less than about 1:1. In yet other embodiments, a ratio of the top edge length AA to the bottom length EE can be less than about 9:10. In some embodiments, a ratio of the top edge length AA to the bottom length EE can be in a range between about 1:2 and about 3:2. In other embodiments, a ratio of the top edge length AA to the bottom length EE can be in a range between about 3:4 and about 1:1. In yet other embodiments, a ratio of the top edge length AA to the bottom length EE can be in a range between about 4:5 and about 9:10.

The body 101 can also have a spearhead offset length FF measured as the distance along the lateral axis 90 between the outer top edge 160 and the outer spearhead corner 143. In some embodiments, a ratio of the spearhead offset length FF to the top edge length AA can be less than about 1:2. In other embodiments, a ratio of the spearhead offset length FF to the top edge length AA can be less than about 1:3. In some embodiments, a ratio of the spearhead offset length FF to the top edge length AA can be in a range between about 1:10 and about 1:2. In other embodiments, a ratio of the spearhead offset length FF to the top edge length AA can be in a range between about 1:8 and about 3:8. In yet another embodiment, a ratio of the spearhead offset length FF to the top edge length AA can be in a range between about 1:5 and about 1:3.

Referring now to FIG. 7, the body 101 can have a body depth GG measured as the distance along the longitudinal axis 85 between the spearhead edge 142 and the rear surface 170. In some embodiments, a ratio of the body depth GG to the outer side height DD can be less than about 1:1. In other embodiments, a ratio of the body depth GG to the outer side height DD can be less than about 1:2. In yet other embodiments, a ratio of the body depth GG to the outer side height DD can be less than about 1:3. In some embodiments, a ratio of the body depth GG to the outer side height DD can be in a range between about 1:10 and about 1:1. In other embodiments, a ratio of the body depth GG to the outer side height DD can be in a range between about 1:4 and about 1:2. In yet other embodiments, a ratio of the body depth GG to the outer side height DD can be in a range between about 1:4 and about 1:3.

Figure 16:
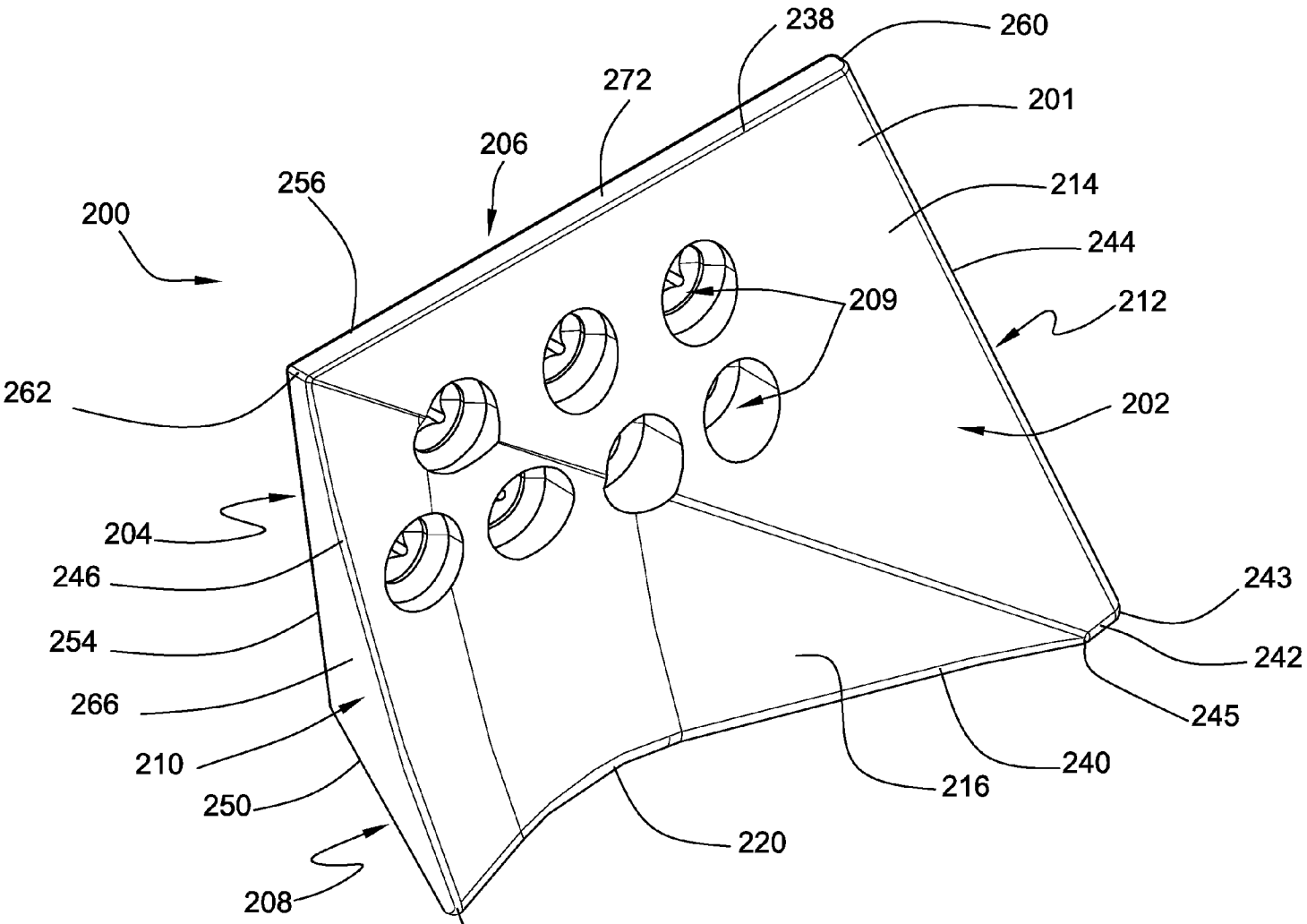
FIG. 16 is a front-left perspective view of another embodiment of an implement end cutting-bit constructed in accordance with the principles of the present disclosure.
Figure 17:
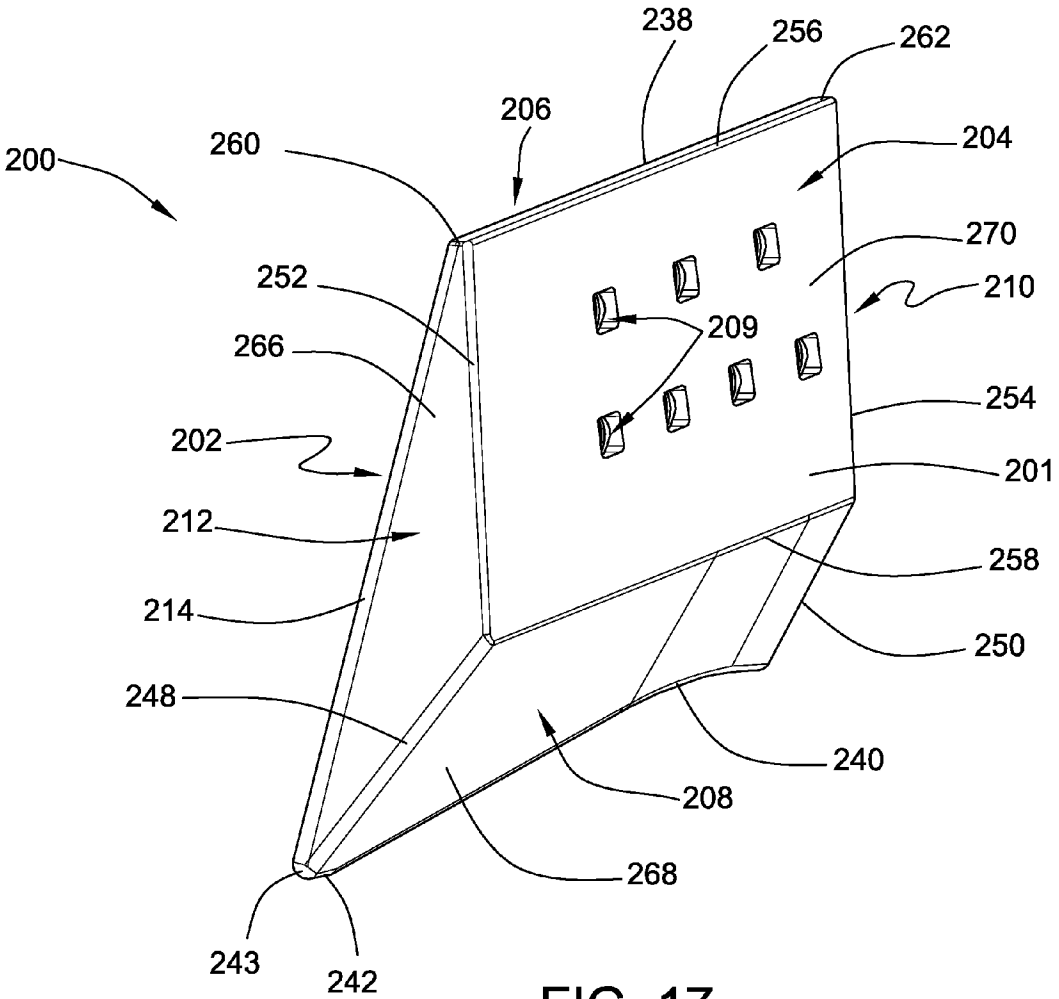
FIG. 17 is a rear-right perspective view of the implement end cutting-bit of FIG. 16.

FIGS. 16 and 17 illustrate an embodiment of the end cutting-bit 200 that can be adapted to be mounted to the earth-working blade 66 at the second blade end 74 of the mounting edge 68. The end cutting-bit 200 can be substantially symmetrical to the end cutting-bit 100 in some embodiments. The end cutting-bit 200 can have a body 201 with a front portion 202 and a rear portion 204 formed on the body. The body 201 can also have an top portion 206, a bottom portion 208, an outer side portion 212, and an inner side portion 210 similar to the corresponding portions of the end cutting-bit 100. Other like-numbered features of the end cutting-bit 200 illustrated in the figures can have similar features to the end cutting-bit 100.

INDUSTRIAL APPLICABILITY

The industrial application of the end cutting-bit as described herein should be readily appreciated from the foregoing discussion. The present disclosure can be applicable to any machine utilizing an earth-working implement for digging, scraping, leveling, excavating or any other suitable application involving engaging the ground or other work material. In machines used for such applications, end cutting-bits and other types of ground engaging tools can wear out quickly and require replacement.

The present disclosure, therefore, can be applicable to many different machines and environments. One exemplary use of the end cutting-bit of this disclosure can be in mining applications in which machine implements can be commonly used to cut, scrape, dig, or clear various work materials including rock, gravel, sand, dirt, and others for protracted time periods and with little downtime. In such applications, reducing the machine passes necessary to clear a particular area can increase work efficiency and speed up the process of clearing the area. The present disclosure has features, as discussed, which can reduce the time needed to clear a particular work area by reducing machine passes by up to half in some applications.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An implement end cutting-bit comprising:

a body having front, rear, top, bottom, inner side and outer side portions, wherein a cutting edge is defined along at least a portion of a bottom interface between the front portion and the bottom portion;

a substantially flat front surface defined on the front portion, the substantially flat front surface extending between:

a top edge disposed along a top interface between the front portion and the top portion, an inner top edge disposed between the inner side portion and the top portion, an outer side edge disposed along an outer side interface between the front portion and the outer side portion, and a convex ridge disposed on the front portion and extending from the inner top edge to the bottom interface adjacent the outer side portion;

a bottom surface defined on the bottom portion adjacent the outer side portion and extending to the cutting edge, the bottom surface defining an angle of less than 60 degrees with the substantially flat front surface; and a contoured front surface formed on the front portion of the body adjacent the substantially flat front surface, the contoured front surface having a generally triangular and concave shape, and a contoured cutting edge having a length, the contoured front surface defined between an inner side edge, which is disposed along an inner side interface between the front portion and the inner side portion, the contoured cutting edge, and the convex ridge, wherein the contoured cutting edge is at least a portion of the cutting edge, and wherein the contoured cutting edge is curved along its length.

2. The implement end cutting-bit of claim 1 further comprising:

an outer side surface defined on the outer side portion of the body, the outer side surface extending between:

the outer side edge, an outer rear edge disposed along an outer rear interface between the rear portion and the outer side portion, and an outer bottom edge disposed along an outer bottom interface between the bottom portion and the outer side portion;

wherein an outer side angle, measured between the substantially flat front surface and the outer side surface with respect to the outer side interface, is less than about 90 degrees.

3. The implement end cutting-bit of claim 1 further comprising:

an outer side surface defined on the outer side portion of the body, the outer side surface extending between:
the outer side edge,
an outer rear edge disposed along an outer rear interface between the rear portion and the outer side portion, and
an outer bottom edge disposed along an outer bottom interface between the bottom portion and the outer side portion;
wherein an outer side angle, measured between the substantially flat front surface and the outer side surface with respect to the outer side interface, is in a range between about 20 degrees and about 60 degrees.

4. The implement end cutting-bit of claim 1 the bottom surface extending between:
the cutting edge,
an outer bottom edge disposed along an outer bottom interface between the bottom portion and the outer side portion,
a rear bottom edge disposed along a rear bottom interface between the rear portion and the bottom portion, and
an inner bottom edge disposed along an inner bottom interface between the bottom portion and the inner side portion;
wherein the angle, measured between the substantially flat front surface and the bottom surface is in a range between about 25 degrees and about 45 degrees.

5. The implement end cutting-bit of claim 1, further comprising a rear surface defined on the rear portion and defining a rear surface plane, the rear surface plane substantially parallel to a normal-lateral plane, wherein a flat front surface plane, defined along the substantially flat front surface, is disposed at an angle in a range between about 10 degrees and about 20 degrees with respect to the normal-lateral plane.

6. An implement end cutting-bit comprising:
a body having front, rear, top, bottom, inner side and outer side portions, wherein a cutting edge is defined along at least a portion of a bottom interface between the front portion and the bottom portion;
a rear surface defined on the rear portion and defining a rear surface plane, the rear surface plane substantially parallel to a normal-lateral plane;
a flat front surface defined on the front portion, the flat front surface extending between:
a top edge disposed along a top interface between the front portion and the top portion,
an inner top edge disposed between the inner side portion and the top portion, an outer side edge disposed along an outer side interface between the front portion and the outer side portion, and
a convex ridge disposed on the front portion and extending in a straight line from the inner top edge to the bottom interface adjacent the outer side portion,
wherein a flat front surface plane is defined along the flat front surface, the flat front surface plane disposed at an angle in a range between about 10 degrees and about 20 degrees with respect to the normal-lateral plane,
a bottom surface defined on the bottom portion of the body, wherein the bottom surface extends to the cutting edge and defines an angle of less than 60 degrees with the flat front surface plane, and
a contoured front surface having a generally triangular and concave shape, and a contoured cutting edge having a length, the contoured front surface formed on the front portion of the body adjacent the flat front surface and defined between an inner side edge, which is disposed along an inner side interface between the front portion and the inner side portion, the contoured cutting edge, and the convex ridge, wherein the contoured cutting edge is at least a portion of the cutting edge, and wherein the contoured cutting edge is curved along its length.

7. The implement end cutting-bit of claim 6, further comprising:
an outer side surface defined on the outer side portion of the body, the outer side surface extending between:
the outer side edge,
an outer rear edge disposed along an outer rear interface between the rear portion and the outer side portion, and
an outer bottom edge disposed along an outer bottom interface between the bottom portion and the outer side portion.

8. The implement end cutting-bit of claim 7, wherein an outer side angle, measured between the flat front surface and the outer side surface with respect to the outer side interface, is less than about 90 degrees.

9. The implement end cutting-bit of claim 7, wherein an outer side angle, measured between the flat front surface and the outer side surface with respect to the outer side interface, is in a range between about 35 degrees and about 80 degrees.

10. The implement end cutting-bit of claim 6,
the bottom surface extending between:
the cutting edge,
an outer bottom edge disposed along an outer bottom interface between the bottom portion and the outer side portion,
a rear bottom edge disposed along a rear bottom interface between the rear portion and the bottom portion, and
an inner bottom edge disposed along an inner bottom interface between the bottom portion and the inner side portion.

11. The implement end cutting-bit of claim 6, wherein the convex ridge terminates at the inner top edge and forms a ridge angle of between 20 degrees and 50 degrees with respect to a lateral axis.

12. The implement end cutting-bit of claim 6, wherein the convex ridge forms an angle of less than 55 degrees with respect to the outer side edge.

13. An implement end cutting-bit system comprising:
at least one end cutting-bit adapted to be mounted to a mounting edge of an earth-working blade, the mounting edge defined between a first blade end and a second blade end, wherein the at least one end cutting-bit comprises:
a body having front, rear, top, bottom, inner side and outer side portions, wherein a cutting edge is defined along at least a portion of a bottom interface between the front portion and the bottom portion;
a flat front surface defined on the front portion, the flat front surface extending between:
a top edge disposed along a top interface between the front portion and the top portion,
an inner top edge disposed between the inner side portion and the top portion; an outer side edge disposed along an outer side interface between the front portion and the outer side portion,
a convex ridge disposed on the front portion and extending from the inner top edge to the bottom interface adjacent the outer side portion, and a contoured front surface formed on the front portion of the body adjacent the flat front surface, the contoured front surface having a generally triangular and concave shape, and a contoured cutting edge having a length, the contoured front surface defined between an inner side edge, which is disposed along an inner side interface between the front portion and the inner side portion, the cutting edge, and the convex ridge; wherein the contoured cutting edge is at least a portion of the cutting edge, wherein the contoured cutting edge is curved along its length, and wherein a flat front surface plane is defined along the flat front surface, and a bottom surface defined on the bottom portion of the body, wherein the bottom surface extends to the cutting edge and defines an angle of less than 60 degrees with the flat front surface plane; and at least one intermediate cutting-bit adapted to be mounted along the mounting edge of the earth-working blade between the first blade end and the second blade end.

14. The implement end cutting-bit system of claim 13, wherein the at least one end cutting-bit is a first end cutting-bit and a second end cutting-bit, the first end cutting-bit adapted to be mounted to the mounting edge of the earth-working blade at the first blade end and the second end cutting-bit adapted to be mounted to the mounting edge of the earth-working blade at the second blade end, and wherein the at least one intermediate cutting-bit is adapted to be mounted to the mounting edge between the first end cutting-bit and the second end cutting-bit.

* * * * *